United States Patent [19]

Darnell

[11] Patent Number: 4,756,215

[45] Date of Patent: Jul. 12, 1988

[54] TORQUE MULTIPLIER WRENCH

[76] Inventor: Cecil Darnell, 4025 Cedar Bayou, Dallas, Tex. 75244

[21] Appl. No.: 110,216

[22] Filed: Oct. 19, 1987

[51] Int. Cl.[4] ..... B25B 17/00

[52] U.S. Cl. ..... 81/57; 81/57.24; 81/57.3; 81/124.4; 29/240

[58] Field of Search ..... 81/124.4, 177.85, 57, 81/57.14, 57.22, 57.24, 57.3, 57.32; 29/270, 240, 242

[56] References Cited

U.S. PATENT DOCUMENTS

| | | | |
|---|---|---|---|
| 1,824,300 | 9/1931 | Rowland | 81/57.32 |
| 2,979,943 | 4/1961 | Gualtieri . | |
| 4,063,475 | 12/1977 | Perkins | 81/57.22 |
| 4,212,196 | 7/1980 | Krieger et al. . | |
| 4,274,310 | 6/1981 | Michaud . | |
| 4,446,762 | 5/1984 | Junkers . | |
| 4,549,438 | 10/1985 | Grabovac . | |
| 4,665,756 | 5/1987 | Snyder . | |

*Primary Examiner*—Frederick R. Schmidt
*Assistant Examiner*—Maurina Rachuba
*Attorney, Agent, or Firm*—Crutsinger & Booth

[57] ABSTRACT

Improved torque multiplier wrench for installing or removing retaining bolts, nuts and the like from rotatable objects such as the flywheel on the shaft of an automobile engine. The tool is fitted near one end with a portion adapted for torqueing engagement with the head of the bolt, nut or other removable object, and is further fitted near the other end with a toothed rotatable member adapted for engagement with a surface at or near the rim of the flywheel or the like. By turning the toothed rotatable member while it is in engagement with the flywheel or similar member, motion of the adjacent end wrench is made to occur, thus imparting torque to the opposite end that is in engagement with the bolt, nut or similar object.

16 Claims, 2 Drawing Sheets

TORQUE MULTIPLIER WRENCH

BACKGROUND OF THE INVENTION

This invention relates to improved tools and more particularly to tools adapted for removing and/or installing items mounted on rotatable shafts.

As is well known to those skilled in the art, tightening bolts, nuts or the like that are mounted on the axis of a rotatable shaft can present considerable difficulty unless the shaft is secured to prevent its rotation. Thus, for example, if one end of an unsecured shaft is threaded to receive a mating member, any attempt to tighten the mating member is met with rotation of the shaft, and there may be little or not restraining torque on the shaft against which the mating member can act.

An example of the foregoing problem is found in situations in which a nut is employed to secure the flywheel of an engine onto its supporting/rotating shaft. An attempt to apply sufficient torque by a conventional wrench will cause the shaft to rotate and prevent the wrench from imparting sufficient operating torque to tighten the nut adequately or to loosen it.

Various proposals have heretofore been made for solving the above-stated problem. These include securing the shaft from rotation or temporarily affixing some portion of the torquing apparatus to some portion of the member mounted on the rotatable axis. Illustrative of the latter is the torque multiplication device disclosed in U.S. Pat. No. 4,274,310 which was granted to Robert P. Michaud on June 23, 1981. Other seemingly less related proposals are illustrated in U.S. Pat. Nos. 4,212,196 granted to R. L. Krieger et. al. on July 15, 1980 and 4,665,755 granted to R. F. Snyder on May 19, 1987. However, the mechanisms of these patents are relatively complex and expensive. Accordingly, there has continued to be a need for a tool that is relatively simple, compact, inexpensive and efficacious.

BRIEF SUMMARY OF THE INVENTION

The improved wrench according to this invention provides an inexpensive and simple solution to the foregoing problems by including in one elongated body or housing, a pair of separately disposed engagement regions, the first of which is adapted for temporary torquing engagement with the fastening member such as the head of a securing device like a bolt or nut. The second of these engagement regions is disposed near the opposite end of the elongated housing and comprises a toothed drive gear adapted for engaging corresponding teeth on the member (e.g., the periphery of a flywheel) which is to be installed/removed.

OBJECTS AND FEATURES

It is one general object of this invention to improve tools adapted for installing or removing objects such as flywheels from rotatable shafts.

It is another object of this invention to facilitate production of such tools by simplifying their manufacture and reducing cost.

It is yet another object of this invention to provide an improved means of producing torque between an item such as an engine flywheel and its mounting shaft.

It is still another object of this invention to facilitate installing or removing the work item while concurrently proving a known level of torque multiplication.

In accordance with one embodiment of the invention, an axially elongated body member is provided at one end thereof, with a portion adapted for temporary torquing engagement with a threaded fastening device used to attach a member such as an engine flywheel, while the opposite end of the body member is provided with a rotatable drive gear adapted for engagement with mating teeth on the attached member (flywheel).

In accordance with one feature of the invention, the axis of rotation of the rotatable drive gear is parallel to and displaced radially from the axis of the portion adapted for temporary torquing engagement with the threaded fastener.

In accordance with still another feature of the invention, the geometries of the tool are such that a predetermined torque multiplication is provided, such torque multiplication being equal to the ratio of (1) the distance between the axes of the fastener engaging portion and the rotatable gear drive less the effective radius of the rotatable gear drive divided by (2) the effective radius of the rotatable gear drive.

These and other objects and features of the invention will be apparent from the following detailed description of a preferred embodiment, with reference to the drawing in which:

DESCRIPTION OF A PREFERRED EMBODIMENT

Figure 1:
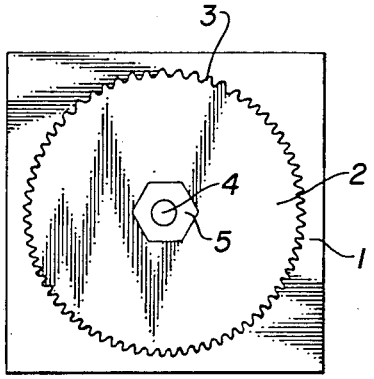
FIG. 1 depicts somewhat schematically a flywheel end elevation view of a typical engine for which the tool of the invention is specially adapted.

Now turning to the drawing, it will be observed that in FIG. 1 there is schematically depicted an engine generally shown as rectangle 1. Mounted on engine 1 is flywheel 2 having at the circular periphery thereof, teeth 3. Protruding from the main body of the engine is flywheel shaft 4 on which flywheel 2 is mounted. The outer end of the flywheel shaft is threaded to accept affixing nut 5 which, when properly installed and tightened to a predetermined torque, retains the flywheel in fixed mounted relationship on shaft 4.

Figure 2:
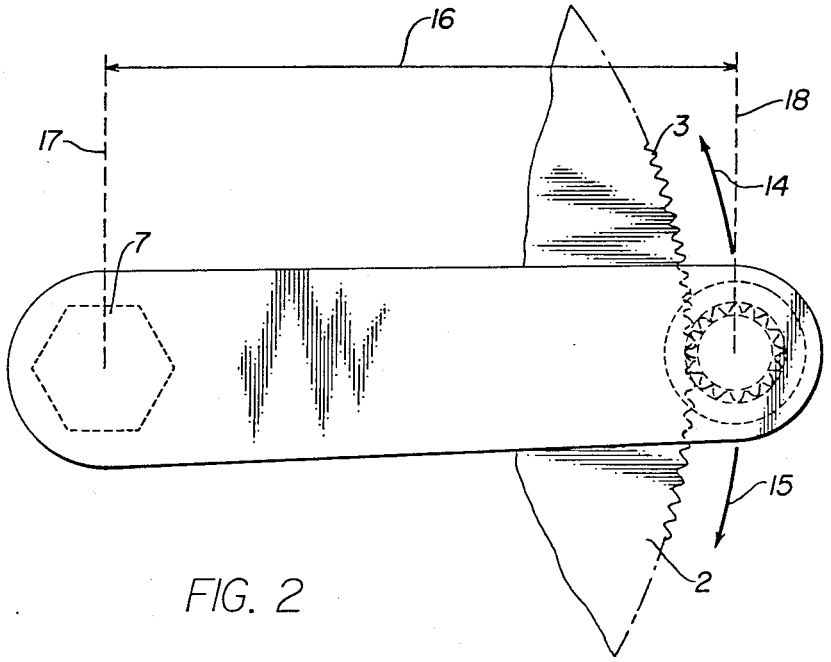
FIG. 2 is an enlarged fragmentary view of the engine of FIG. 1 illustrating the torque multiplier wrench of this invention in place for installation or removal of the flywheel fastening member.

FIG. 2 depicts a part of the configuration of FIG. 1 in greater detail. There, it will be seen is shown a part of the flywheel 2 with its peripheral teeth 3 and with the improved torque multiplier wrench 20 of this invention in place for tightening or loosening the mounting nut 5. But before proceeding further to describe FIG. 2, it may be helpful to refer to a depiction of the tool itself as shown in FIGS. 3 and 4.

Figure 3:
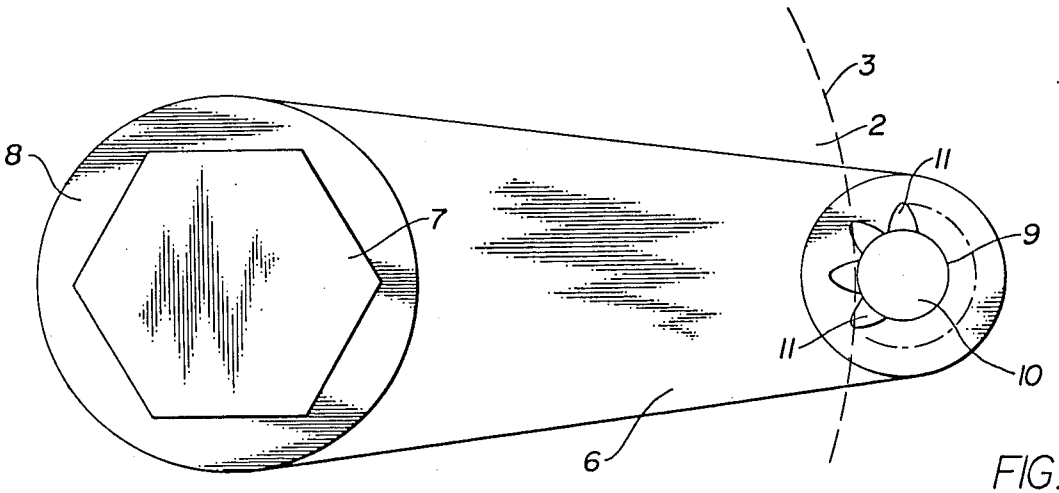
FIG. 3 is a bottom plan view of a tool in accordance with a preferred embodiment of this invention.

In FIG. 3, there is shown a view of a preferred embodiment of the tool according to this invention. This tool comprises a main structural member 6 having at opposite ends thereof, operative portions of the tool. Adjacent the left end of the tool there is found a conventional hex-shaped socket 7 within rounded portion 8; and adjacent the right end of the tool is disposed a rotatable drive gear assembly 9 having gear 10 with teeth 11 whose characteristics correspond to those of the teeth 3 on the periphery of the flywheel 2.

At the top (FIG. 4) of the drive gear assembly 9 there is a conventional portion by which torque and rotational motion may be imparted to the drive gear. This is illustrated by projection 12 which contains a conventional recess 13 for accepting a standard drive, for example, a one-half inch square drive (not shown). At the lower end of the drive gear assembly 9 there projects downwardly an exposed portion of gear 10 which communicates with projection 12 through interconnecting shaft 14 that is rotatably supported within the tool main structural member 6 by conventional means such as those well known in the art. Accordingly, when a drive is inserted into recess 13, turning of the drive will cause corresponding rotation of the gear 10.

Figure 4:
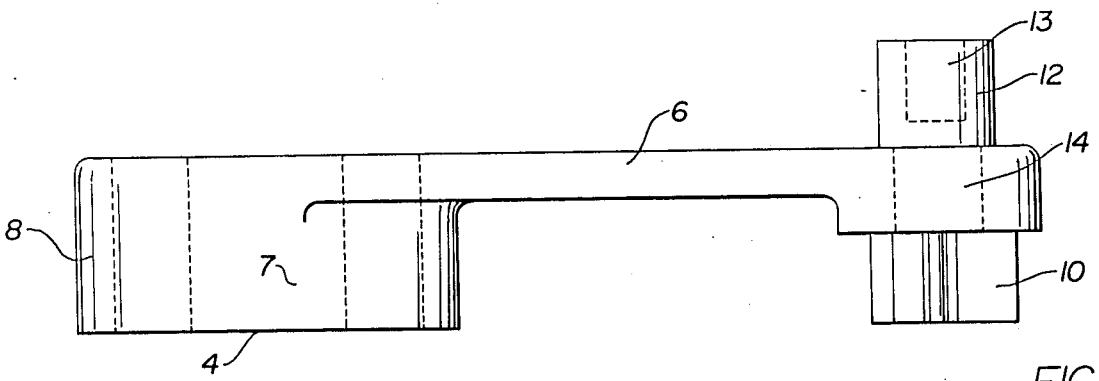
FIG. 4 is a side elevation view of the tool of FIG. 3.

Now returning to FIG. 2, it will again be observed that the torque multiplier wrench of FIGS. 3 and 4 is shown in place for tightening or loosening the mounting nut 5. Hex-shaped socket 7 of portion 8 is engaged with flywheel affixing nut 5 in the conventional manner, and rotatable drive gear teeth 11 are engaged with flywheel teeth 3 in mating relationship. Accordingly, it will be apparent that when rotational motion is imparted to drive gear assembly 9 by the insertion into recess 13 and rotational movement of the aforementioned standard drive (not shown), a corresponding movement of the tool results as the rotatable drive gear assembly teeth 11 process circumferentially along teeth 3 of drive wheel 2 as shown by counterclockwise and clockwise arrows 14 and 15 respectively, thus causing the axis of the rotatable drive gear assembly to move in an orbited path about the axis of the socket 7. This in turn imparts torque through the body of tool 6 to socket 7 and thence to nut 5, producing relative rotation between the nut 5 and the shaft 4 to which the flywheel is keyed, thereby either tightening or loosening it according to whether the drive is turned clockwise or counterclockwise.

As will be evident from the foregoing description, the torque applied to nut 5 by the tool is independent of whether or not the engine shaft 4 is free to turn, for the equal and opposite reaction to the torque is transmitted through the teeth 11 of the rotatable drive gear assembly 9 to the teeth 3 of the flywheel 2 and thence through the flywheel back to the shaft 4 to which the flywheel is keyed. Accordingly, as mentioned above, it is not necessary to block the shaft 4 from turning.

Not only is the tool effective in imparting torque to the fastening member (e.g., nut 5) irrespective of whether the mounting shaft 4 is free to turn, but in addition it provides an attractive feature of known torque multiplication. Thus, it has been found that the torque applied by the drive is multiplied by a factor essentially equal to the ratio of: (1) the distance 16 between the axis 18 of the rotatable drive gear and the axis 17 of socket 7, less the effective radius of the drive gear 10, divided by the effective radius of the rotatable drive gear 10. By this feature, not only is torque increased substantially, but the torque multiplication factor is known and remains constant for any given tool, thus simplifying the calculation of effective torque when using a calibrated drive.

It will now be evident that there has been described herein, an improved tool that efficaciously and economically solves the problem of disengageably affixing a member to a free-to-turn shaft. It should also be evident that the improved tool is relatively simple in design and easy and relatively inexpensive to manufacture, thus contributing to its attractiveness and desirability.

Although the invention hereof has been described by way of example of a preferred embodiment, it will be evident that other adaptations and modifications may be employed without departing from the spirit and scope thereof. For example, a secondary reduction gear could be disposed in cooperative with the rotatable drive gear 10, thus further increasing effective torque multiplication.

The terms and expressions employed herein have been used as terms of description and not of limitation; and thus, there is not intent of excluding equivalents, but on the contrary it is intended to cover any and all equivalents that may be employed without departing from the spirit and scope of the invention.

What is claimed is:

1. An improved tool especially adapted for tightening and loosening a fastener in the installation and removal of a member having circularly disposed teeth, said member being mounted on a rotatable support, comprising: an elongated main structural member; a fastener engaging portion disposed adjacent one end of said main structural member; and a drive-engaging portion disposed adjacent the remaining end of said main structural member; said fastener engaging portion being adapted for mating with a corresponding portion of said fastener thereby to transmit torque thereto; and said drive engaging portion comprising a first part adapted for receiving a removable torque-producing member, a gear, means connecting said first part with said gear thereby to conduct torque therebetween; said fastener engaging portion being disposed about a first axis; said drive engaging portion being disposed about a second axis; and wherein, when said fastener engaging portion is engaged with said fastener and the teeth of said gear are engaged with said circularly disposed teeth, and when rotational movement is imparted to said gear, said second axis moves in an optical path around said first axis.

2. An improved tool according to claim 1 in which said first and second axes are parallel to each other.

3. An improved tool according to claim 1 in which said gear projects outside said elongated structural member.

4. An improved tool according to claim 1 in which said first and second axes are parallel to each other and in which said gear projects outside said elongated structural member.

5. An improved tool according to claim 1 in which said drive-engaging portion is adapted for receiving a standard drive.

6. An improved tool according to claim 1 in which said fastener engaging portion is engaged with said fastener and said drive engaging portion is engaged with said member having circularly disposed teeth.

7. An improved tool according to claim 1 including predetermined torque multiplication.

8. An improved tool according to claim 7 in which said torque multiplication is equal to the distance between the axes of the fastener engaging portion and said drive engaging portion less the effective radius of said drive engaging portion divided by the effective radius of said drive engaging portion.

9. An improved tool especially adapted for tightening and loosening a threaded device which secures on a rotatable support a member having circularly disposed teeth, said tool comprising: an elongated structure having at one end a socket for engaging said threaded device, and having at the opposite end a gear for engaging the teeth of said member wherein when the socket is engaged with the threaded device, and when the ear is engaged with the teeth of said member, and when the gear is rotated said gear moves in an orbital path around the threaded device, causing the threaded device to loosen or tighten on the rotatable support.

10. An improved tool according to claim 9 including predetermined torque multiplication.

11. An improved tool according to claim 10 in which said torque multiplication is equal to the distance between the axes of said socket and said gear less the effective radius of said gear, divided by the effective radius of said gear.

12. An improved tool according to claim 9 in which said threaded device is a conventional nut.

13. An improved tool according to claim 9 in which said threaded device is a conventional bolt.

14. An improved tool according to claim 9 in which said rotatable support is an extension of the crankshaft of an engine.

15. An improved tool according to claim 9 in which said member having circularly disposed teeth is the flywheel of an engine.

16. An improved tool especially adapted for tightening and loosening a threaded fastener which secures on the shaft of an engine a flywheel having circularly disposed teeth about the periphery thereof, said tool comprising: an elongated structure having at one end a socket for engaging said threaded fastener, and having at the opposite end a rotatable gear for engaging the teeth of said flywheel wherein when the socket is engaged with the threaded fastener, and when the rotatable gear is engaged. With the teeth of said flywheel, and when the gear is rotated, said gear moves in an orbital path about said flywheel, causing the threaded fastener to loosen or tighten on the shaft of the engine.

* * * * *

UNITED STATES PATENT AND TRADEMARK OFFICE

CERTIFICATE OF CORRECTION

PATENT NO. : 4,756,215

DATED : July 12, 1988

INVENTOR(S) : Cecil Darnell

It is certified that error appears in the above-identified patent and that said Letters Patent is hereby corrected as shown below:

Column 1, line 34, change "4,665,755" to --4,665,756--;
Column 4, line 37, change "optical" to --orbital--;
Column 5, line 2, change "ear" to --gear--.

Signed and Sealed this

Eighth Day of November, 1988

*Attest:*

DONALD J. QUIGG

*Attesting Officer*

*Commissioner of Patents and Trademarks*